United States Patent [19]

Nilssen

[11] Patent Number: 4,698,553

[45] Date of Patent: Oct. 6, 1987

[54] ELECTRONIC POWER SUPPLY SYSTEM

[76] Inventor: Ole K. Nilssen, Caesar Dr., Barrington Hills, Ill. 60010

[21] Appl. No.: 677,562

[22] Filed: Dec. 3, 1984

[51] Int. Cl.[4] ..... H05B 37/00

[52] U.S. Cl. ..... 315/200 R; 315/102; 315/105

[58] Field of Search ..... 315/102, 101, 105–107, 315/172, 174, 160, 244, 246, 287, 127, 200 R

[56] References Cited

U.S. PATENT DOCUMENTS

| | | | |
|---|---|---|---|
| 3,651,371 | 3/1972 | Tingley | 315/102 |
| 4,256,992 | 3/1981 | Luursema | 315/106 |
| 4,259,614 | 3/1981 | Kohler | 315/244 X |
| 4,398,126 | 8/1983 | Zuchtriegel | 315/127 |

FOREIGN PATENT DOCUMENTS

| | | | |
|---|---|---|---|
| 2446579 | 9/1980 | France | 315/102 |

*Primary Examiner*—David K. Moore

[57] ABSTRACT

With the AC voltage output from an inverter series-driving a high-Q parallel-loaded resonant L-C circuit, and with the parallel-connected load being of a type that needs to be conditioned before it will absorb power (as would be the case with loads such as magnetrons or fluorescent lamps), the inverter and/or the L-C circuit may be destructively overloaded during the time it takes for the load to become conditioned.

In a power-line-operated inverter-type power supply with such a high-Q parallel-loaded resonant L-C circuit series-connected across its output, subject invention provides for means to prevent such destructive overload. In this power supply, the unfiltered pulsed DC output of a full-wave power-line-supplied rectifier is applied to a pair of inverters: an auxiliary inverter for pre-conditioning the load, and a main inverter for powering the load. The auxiliary inverter starts operating immediately upon application of power from the power line, and therefore immediately starts the process of conditioning the load. The main inverter, however, is not started until after the load has become adequately conditioned, at which time the load will adequately load the series-resonant L-C circuit.

If at any time the main inverter is operating, but if the load is removed or otherwise fails to adequately load the L-C circuit, the main inverter is immediately disabled for a pre-determined period.

18 Claims, 1 Drawing Figure

ELECTRONIC POWER SUPPLY SYSTEM

BACKGROUND OF THE INVENTION

1. Field of the Invention

The present invention relates to a power-line-operated inverter-type power supply operable to series-drive a high-Q parallel-loaded resonant L-C circuit, especially in applications where the load is of a type that must be conditioned before becoming conductive.

2. Background Considerations

Normally, a load that must be conditioned before becoming conductive is one that depends on electron emission for its conductivity. Such loads include fluorescent lamps and vacuum tubes.

In such a load, a cathode must be heated to incandescence before electron emission starts; and this heating proccss is apt to take on the order of one to several seconds. Thus, aside from the relatively modest amount of power needed to accomplish the conditioning, such a load is substantially a non-load until its cathode has reached incandescence.

In many applications of inverter-type power supplies, such as in inverter-type ballasts for fluorescent lamps, or in inverter-type microwave oven power supplies, it is often desirable to power such a load by way of having it parallel-connected across the tank capacitor of a high-Q resonant L-C circuit—with this L-C circuit itself being series-connected directly across the output of the inverter.

However, when such a high-Q series-resonant L-C circuit is not loaded, it acts substantially as a short circuit; which, during even a brief period (such as during the one or two seconds it takes for the load to become conductive), is apt to bring destruction to the inverter and/or to the L-C circuit itself.

One way of preventing such destructive overload is that of connecting in parallel with the load a voltage-limiting means (like a Varistor) characterized by: (i) not conducting at the highest magnitude of voltage normally present across the load when it is conducting; and (ii) conducting heavily at a voltage of somewhat higher magnitude than that.

However, in many applications, due to the very significant amount of energy that must be absorbed by this voltage limiting means, even if the required conditioning period is only a couple of seconds in duration, the effective cost associated with such a method of preventing destruction of inverter and/or L-C circuit is very high.

Also, the potential inefficiency involved—as for instance in a situation where the load is simply removed from the L-C circuit—can represent a major obstacle to designing a fully functional product.

SUMMARY OF THE INVENTION

Objects of the Invention

An object of the present invention is that of providing an inverter-type power supply operative to safely power a high-Q parallel-loaded series-resonant L-C circuit where the parallel-connected load is of a type that needs to be conditioned before it can absorb power.

This as well as other important objects and advantages of the present invention will become apparent from the following description.

Brief Description

In its preferred embodiment, subject invention relates to a power-line-operated electronic inverter-type power supply operable to series-drive a high-Q parallel-loaded resonant L-C circuit, where the load is of such a nature as to have to be conditioned for a period of about two seconds before becoming fully conductive.

In this power supply, the unfiltered pulsed DC output of a full-wave rectifier is applied to a pair of inverters: an auxiliary inverter for pre-conditioning the load, and a main inverter for powering the load. The auxiliary inverter starts operating immediately upon application of power from the power line; and its output is used for conditioning the load. The main inverter is started after the load has been fully conditioned.

Both inverters are of the type that must be triggered into oscillation; and, since the pulsed DC supply voltage falls to zero magnitude once every half-cycle of the 60 Hz power line voltage, and since the inverters then cease oscillating, it is necessary for each inverter that it be re-triggered for each half-cycle of 60 Hz voltage for as long as power output is desired from it.

In case the load is removed or otherwise ceases to conduct, the re-triggering function for the main inverter is blocked for a few seconds, thereby disabling the main inverter and preventing it from destructive overload. After a few seconds, the main inverter is again triggered; but, if the overload condition still exists, the re-triggering mechanism will again be blocked.

DESCRIPTION OF THE PREFERRED EMBODIMENT

Details of Construction

Figure 1:
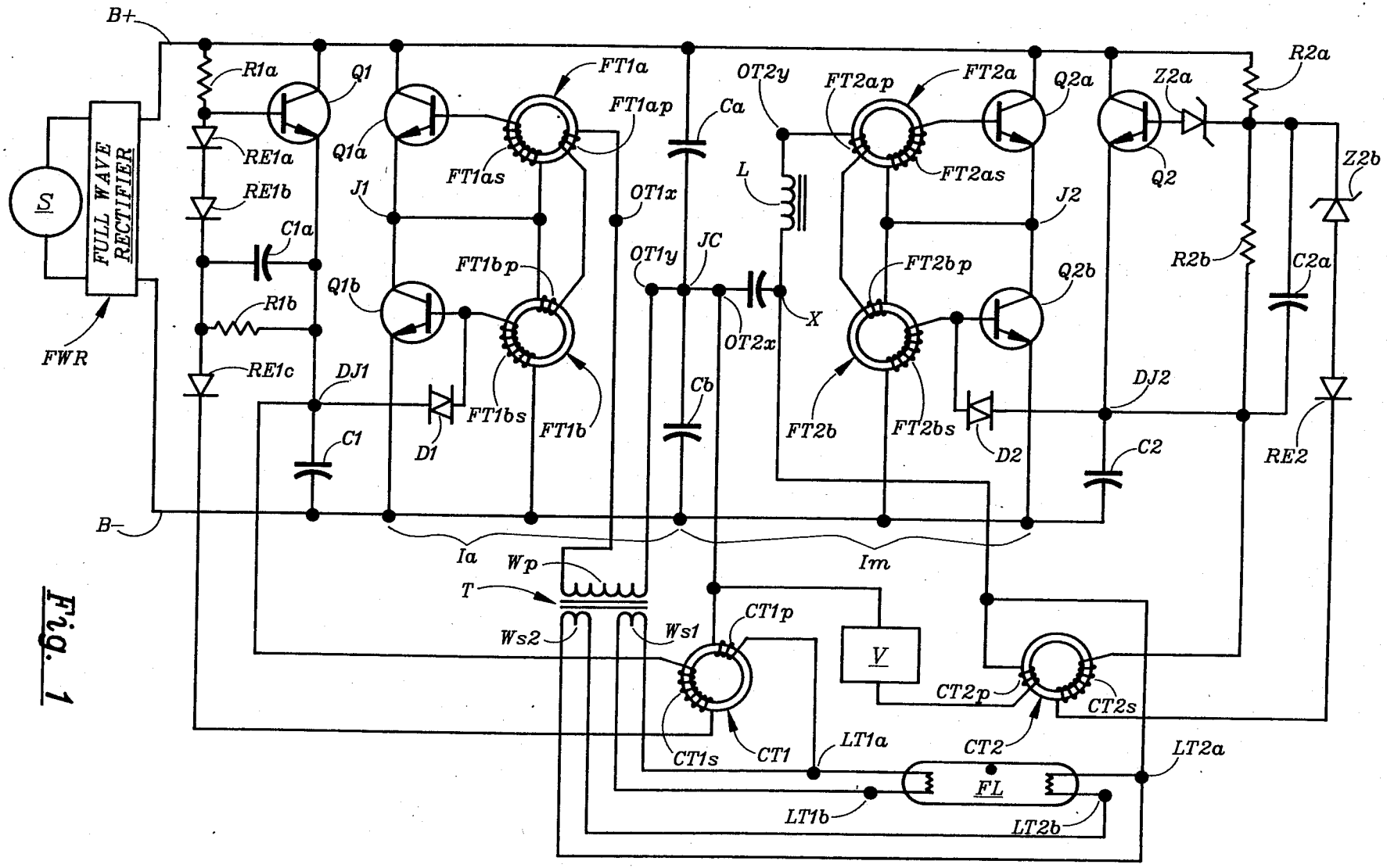
FIG. 1 schematically illustrates the preferred embodiment of the invention.

FIG. 1 shows an AC voltage source S, which in reality is an ordinary 120 Volt/60 Hz electric utility power line.

Connected to S is a full-wave rectifier FWR that rectifies the AC voltage from S to provide an unfiltered DC voltage between a positive power bus B+ and a negative power bus B−.

A first pair of transistors Q1*a* and Q1*b* are connected in series between the B+ bus and the B− bus in such a way that the collector of Q1*a* is connected to the B+ bus, the emitter of Q1*a* is connected with the collector of Q1*b* at a junction J1, and the emitter of Q1*b* is connected with the B− bus.

A second pair of transistors Q2*a* and Q2*b* are connected in series between the B+ bus and the B− bus in such a way that the collector of Q2*a* is connected to the B+ bus, the emitter of Q2*a* is connected with the collector of Q2*b* at a junction J2, and the emitter of Q2*b* is connected with the B− bus.

Primary winding FT1*ap* of saturable feedback transformer FT1*a* and primary winding FT1*bp* of saturable feedback transformer FT1*b* are connected in series between junction J1 and output terminal OT1*x*. Another object terminal OT1*y* is connected with junction JC between capacitors Ca and Cb; which capacitors are connected in series between the B+ bus and the B− bus.

Primary winding FT2*ap* of saturable feedback transformer FT2*a* and primary winding FT2*bp* of saturable feedback transformer FT2*b* are connected in series between junction J2 and output terminal OT2*y*. Another output terminal OT2*x* is connected with junction JC.

Secondary winding FT1*as* of feedback transformer FT1*a* is connected between the base and the emitter of transistor Q1*a;* and secondary winding FT1*bs* of feedback transformer FT1*b* is connected between the base and the emitter of transistor Q1*b*.

Secondary winding FT2*as* of feedback transformer FT2*a* is connected between the base and the emitter of transistor Q2*a;* and secondary winding FT2*bs* of feedback transformer FT2*b* is connected between the base and the emitter of transistor Q2*b*.

A capacitor C is connected between output terminal OT2*x* and a point X; and an inductor L is connected between point X and output terminal OT2*y*.

Primary winding Wp of transformer T is connected with inverter output terminals OT1*x* and OT1*y*. Secondary winding Ws1 of transformer T is connected with lamp terminals LT1*a* and LT1*b* of fluorescent lamp FL; and secondary winding Ws2 of transformer T is connected with lamp terminals LT2*a* and LT2*b* of FL.

Lamp terminal LT2*a* is connected with point X, and lamp terminal LT1*a* is connected with output terminal OT2*x* by way of primary winding CT1*p* of control transformer CT1.

A Varistor V is connected between point X and output terminal OT2*x* by way of primary winding CT2*p* of control transformer CT2.

Secondary winding CT1*s* of control transformer CT1 is connected between a junction DJ1 and the cathode of a rectifier RE1*c*. An auxiliary transistor Q1 is connected with its collector to the B+ bus and with its emitter to junction DJ1. A capacitor C1 is connected between junction DJ1 and the B− bus; and a Diac D1 is connected between junction DJ1 and the base of transistor Q1*b*. A resistor R1*b* and a capacitor C1*a* are connected in parallel between junction DJ1 and the anode of rectifier RE1*c*.

A resistor R1*a* is connected between the B+ bus and the base of transistor Q1; and two rectifiers RE1*a* and RE1*b* are connected in series between the base of transistor Q1 and the anode of RE1*c*—with the anode of RE1*a* being connected with the base of transistor Q1, and with the anode of RE1*b* being connected with the cathode of RE1*a*.

Secondary winding CT2*s* of control transformer CT2 is connected between a junction DJ2 and the cathode of a rectifier RE2. An auxiliary transistor Q2 is connected with its collector to the B+ bus and with its emitter to junction DJ2. A capacitor C2 is connected between junction DJ2 and the B− bus; and a Diac D2 is connected between junction DJ2 and the base of transistor Q2*b*. A resistor R2*b* and a capacitor C2*a* are connected in parallel between junction DJ2 and the cathode of a Zener diode Z2*a*, whose anode is connected with the base of auxiliary transistor Q2.

A resistor R2*a* is connected between the B+ bus and the cathode of Zener diode Z2*a*. A Zener diode Z2*b* is connected with its cathode to the cathode of Zener diode Z2*a* and with its anode to the anode of rectifier RE2. The threshold voltage of Zener diode Z2*b* is slightly higher than that of Zener diode Z2*a*.

The assembly consisting of transistors Q1*a* and Q1*b*, feedback transformers FT1*a* and FT1*b*, and output terminals OT1*x* and OT1*y* is referred to as auxiliary inverter I*a*. The assembly consisting of transistors Q2*a* and Q2*b*, feedback transformers FT2*a* and FT2*b*, and output terminals OT2*x* and OT2*y* is referred to as main inverter Im.

Description of Operation

The operation of the arrangement of FIG. 1 may be further explained as follows.

FIG. 1 shows two half-bridge inverters: an auxiliary inverter Ia consisting of transistors Q1*a* and Q1*b* with their respective saturable positive feedback transformers FT1*a* and FT1*b;* and a main inverter Im consisting of transistors Q2*a* and Q2*b* with their respective saturable positive feedback transformers FT2*a* and FT2*b*.

Both inverters are capable of self-oscillation by way of positive feedback. When they do oscillate, the frequency of oscillation is about 30 kHz. For further explanation of the operation of this type of inverter, reference is made to U.S. Pat. No. 4,184,128, and particularly to FIG. 8 thereof.

Each of these inverters has to be triggered into oscillation; but they will only oscillate as long as the magnitude of the voltage between the B− bus and the B+ bus exceeds about 20 Volt. Thus, if one of the inverters is triggered into oscillation at the beginning of one of the sinusoidally-shaped DC voltage pulses existing between the B− bus and the B+ bus (as resulting from the unfiltered full-wave rectification of the voltage from the ordinary 120 Volt/60 Hz power line), that inverter will cease oscillating at the end of that DC voltage pulse. Thus, to keep either one of the inverters operating on a continuous basis, it is necessary that it be re-triggered at a rate of 120 times per second—i.e, once in the beginning of each half-cycle of the 120 Volt/60Hz power line voltage.

Both the half-bridge inverters use capacitors Ca and Cb to provide for an effective center-tap between the B− bus and the B+ bus—this center-tap being junction JC.

When power line voltage is initially applied to the arrangement of FIG. 1, transistor Q1 will immediately be biased into a conductive state; which implies that capacitor C1 will immediately start to receive charge from the B+ bus. As soon as C1 has reached a voltage high enough to cause breakdown of Diac D1, a trigger pulse will be applied to the base of transistor Q1*b*, thereby initiating auxiliary inverter Ia into self-oscillation.

The time required for capacitor C1 to be charged to Diac breakdown voltage is arranged to be but a small fraction of the length of a half-cycle of the 60 Hz power line voltage; which implies that the auxiliary inverter Ia will be triggered into oscillation at the beginning of each of the 120 Hz DC pulses provided between the B− bus and the B+ bus.

In other words, when it is being continuously triggered, the output from auxiliary inverter Ia will be a relatively high-frequency (30 kHz) squarewave AC voltage 100% amplitude-modulated at a frequency of 120 Hz.

By way of transformer T, the output from auxiliary inverter I*a* is applied to the cathodes of fluorescent lamp FL, thereby conditioning this lamp and making it ready to conduct. For a typical fluorescent lamp, this conditioning takes from 1.0 to 1.5 second, after which time the lamp cathodes have reached incandescence and are capable of adequate electron emission.

And, after this initial conditioning period of at least 1.5 second, main inverter Im is started, thereby providing main power to the fluorescent lamp only after it has become completely thermionic and ready to conduct.

This delayed action on behalf of the main inverter is achieved by providing for a delay in making transistor Q2 conductive; which delay is due to the time it takes for capacitor C2*a* to charge to a voltage high enough to cause current to flow into the base of Q2. After this sufficiently high voltage has been reached, however, the time to charge C2 to the point of breaking down Diac D2 is only a small fraction of the length of a half-cycle of the 120 Volt/60 Hz power line voltage—just as in the case of capacitor C1 and Diac D1.

In other words, when starting from a discharged state, it takes some 1.5 to 2.0 seconds before transistor Q2 reaches the point of being conductive; but once that point is reached, its conductivity is such as to cause capacitor C2 to be charged up with a time-constant of about one millisecond.

Under normal circumstances, as soon as main inverter Im starts to oscillate, the fluorescent lamp instantly ignites (although not in normal instant-start fashion-)—having by that time been fully conditioned to conduct.

The resulting lamp current, flowing through the primary winding CT1*p* of control transformer CT1, now provides for a current to flow from the secondary winding CT1*s* of CT1; which current, for as long as it flows, biases transistor Q1 into a non-conductive state, thereby preventing auxiliary inverter Ia from receiving trigger pulses. Thus, as soon as lamp current starts to flow, the auxiliary inverter ceases to operate, thereby ceasing to provide cathode heating power.

Although not necessary to the basic operation of the overall power supply, it may never-the-less in some situations be advantageous to remove the conditioning voltage after the initial conditioning has been accomplished.

For instance, in using the power supply for powering a fluorescent lamp, it may indeed be advantageous (for energy-efficiency reasons) to remove the cathode heating power after the lamp has ignited. On the other hand, if the power supply were to be used for powering a magnetron in a microwave oven, it would not be desirable to remove the conditioning voltage.

Varistor V is chosen such that it will limit the voltage developing across tank capacitor C to a magnitude that is suitable for proper lamp ignition; which voltage might be of magnitude about twice that of the lamp's normal operating voltage.

If for some reason the fluorescent lamp should not ignite, the magnitude of the voltage developing across capacitor C (as resulting from Q-multiplication) would be limited by the voltage clamping characteristics of Varistor V. Consequently, if the lamp should fail to ignite, current would flow through V and thereby through primary winding CT2*p* of control transformer CT2. This current would, within about one millisecond, charge capacitor C2*a* to a negative voltage; the effect of which would be that of removing the base current from transistor Q2, thereby rendering it non-conductive. With transistor Q2 in a non-conductive state, capacitor C2 does not get charged, and main inverter Im therefore ceases to operate because it does not receive triggering pulses. Of course, with the main inverter in a non-operating state, the current through the Varistor ceases to flow. However, it takes about five seconds for the negative voltage placed on C2*a* (as a result of the Varistor current) to be neutralized by current flowing from the B+ bus through resistor R2*a*. Thereafter, the main inverter again starts receiving its trigger pulses. However, if the lamp still fails to ignite, the same cycle will be repeated.

In other words, each time current flows through the Varistor for but a very brief period, main inverter Im is rendered inoperative for a period of about five seconds.

It is noted that, to prevent redundant triggering of the auxiliary inverter, a diode may be placed between junctions DJ1 and J1—with its cathode connected with J1. Similarly, to prevent redundant triggering of the main inverter, a diode may be placed between junctions DJ2 and J2—with its cathode connected with J2.

Also, in some situations, with some fluorescent lamps, it may be necessary to permit current to flow through the Varistor for a very brief period without immediately causing shut-down of the main inverter. To achieve this effect, a delay means can readily be provided by way of well known art.

It is also noted that, as long as power is flowing through the Varistor, the rate of power dissipation in the Varistor is very large: about twice as large as the normal full power applied to the lamp when it is operating. With this full power being typically on the order of 80 Watt for a pair of fluorescent lamps (which is the most commonly occuring fluorescent lamp load), the implication is that the Varistor has to be able to handle a dissipation of about 160 Watt—at least for a short period. While this level of dissipation can reasonably be handled by an ordinary Varistor for perhaps as long as a few hundred milli-seconds—provided the average Varistor dissipation does not exceed about 1 Watt—it is quite beyond the capability of an ordinary Varistor to handle 160 Watt for as long as 2 seconds, which would result in an accumulated energy dissipation of 320 Joule.

However, if the Varistor is called for to provide voltage limitation every five seconds or so, which is indeed the case in the instant embodiment, then it is unreasonable to subject it to more than about 5 Joule for each such instance of voltage limitation. At a power level of 160 Watt, 5 Joule of energy is put into the Varistor in a matter of about 30 milli-seconds.

It is finally noted that, while the main inverter may be able to handle an overload of about 100% for a period of 30 milli-sedonds, it is far less likely to do so for as long as 2 seconds. However, without the Varistor to provide voltage limitation, the power drawn by the L-C circuit, if for some reason the lamp failed to conduct, would cause far more than 100% overload. Depending on the Q of the L-C circuit, the power drawn from the inverter by an un-loaded series-resonant L-C circuit could readily represent an overload of 500 to 1000%.

It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. The combination comprising:

a main power source operable to provide an AC voltage at an output;

an inductor means and a capacitor means effectively series-connected across the output, the inductor means being resonant with the capacitor means at or near the frequency of the AC voltage;

load means effectively connected in parallel with the capacitor means, the load means requiring conditioning before being operable to effectively absorb power, the load means having an auxiliary input adapted to receive power operable to effect the required conditioning;

an auxiliary power source connected with the auxiliary input and operable to provide power thereto, thereby to effect the required conditioning; and means operable to prevent the main power source from providing the AC voltage at the output until after the auxiliary power source has provided power to the auxiliary input for a pre-determined period of time.

2. A power supply system comprising:

source operable to provide an AC voltage at an output;

L-C circuit resonant at or near the frequency of this AC voltage and effectively series-connected across the output;

load requiring conditioning before being operable to effectively absorb power by way of a set of terminals connected with said L-C circuit, the load having an auxiliary input by which to effect the conditioning;

conditioner connected with this auxiliary input and operable to effect the conditioning; and means to prevent the source from providing the AC voltage until after the conditioning has been effected.

3. The power supply system of claim 2 wherein said L-C circuit effectively constitutes a short circuit across said output before said conditioning has been effected.

4. The power supply system of claim 2 wherein the load comprises a thermionic cathode.

5. The power supply system of claim 2 wherein the source comprises a frequency converting means connected with an ordinary electric power line.

6. The power supply system of claim 5 wherein the frequency of said AC voltage is substantially higher than that of the voltage normally present on said power line.

7. The power supply system of claim 2 comprising means operative to remove said AC voltage in the event that the load ceases to effectively absorb power.

8. The power supply system of claim 2 wherein said AC voltage is of a relatively high frequency and substantially 100% amplitude-modulated at a relatively low frequency.

9. The power supply system of claim 2 wherein said AC voltage may be characterized as being a relatively high frequency squarewave voltage of substantive magnitude alternating periodically with a voltage of non-substantive magnitude.

10. The power supply system of claim 2 wherein said auxiliary input requires a substantive amount of power to effect said conditioning, and where said conditioner is operable to supply this substantive amount of power.

11. The power supply system of claim 10 wherein the load does not require conditioning after it has started to effectively absorb power by way of said terminals, and wherein said conditioner ceases to supply power to the auxiliary input as soon as the load has started to effectively absorb power by way of said terminals.

12. The combination of:

a source operable to provide an AC voltage across an L-C series-circuit, this L-C series-circuit being substantially resonant at the frequency of the AC voltage and connected with a load means that requires pre-conditioning before being effective as a load for the L-C series-circuit;

conditioner means coupled with said load means and operative to accomplish said pre-conditioning; and means to prevent the AC voltage from being provided across said L-C series-circuit until after said pre-conditioning has been accomplished.

13. The combination of claim 12 wherein said L-C series-circuit represents an effective short circuit for said AC voltage prior to said pre-conditioning.

14. A power supply system comprising:

rectifier means connected with an ordinary electric utility power line and operable to provide a DC voltage at a DC output;

inverter means connected with said DC output and controllably operable to provide an AC voltage at an AC output;

an L-C circuit resonant at or near the frequency of this AC voltage and effectively series-connected across this AC output;

load means connected with the L-C circuit, said load means requiring conditioning before being operable to effectively load said L-C circuit and having an auxiliary input by which to accomplish said conditioning, said conditioning requiring a period of time before becoming effective;

a conditioner means connected with this auxiliary input and operable to accomplish said conditioning; and means to prevent the inverter from providing the AC voltage until said conditioning has become effective.

15. A power supply system comprising:

rectifier means connected with an ordinary electric utility power line and operable to provide periodic DC voltage pulses at a DC output, these DC voltage pulses having a relatively low frequency and a pulse period;

inverter connected with said DC output and controllably operable to provide an AC voltage at an AC output, said AC voltage having a relatively high frequency and a short period, this short period being substantially shorter than said pulse period;

an L-C series-circuit resonant at or near said high frequency and connected across said AC output, this L-C series-circuit representing an effective short circuit for said AC output except when being connected with an effective load, said inverter and/or said L-C circuit being subject to destructive overload if said AC voltage is permitted to exist across said AC output for a time period substantially longer than said pulse period while the L-C circuit is not connected with an effective load;

load means connected with the L-C circuit and conditionally operable to constitute an effective load therefor; and means operative within the approximate timespan of said pulse period to prevent the inverter from providing the AC voltage across said AC output if for some reason the load means should fail to constitute an effective load for said L-C circuit.

16. The power sypply system of claim 15 wherein:

the instantaneous magnitude of the periodic DC voltage pulses falls below a certain level at least once during said pulse period;

the inverter is of a type that can provide said AC voltage only as long as said instantaneous magnitude is above said certain level, and then only if triggered into operation; and means operative to prevent the inverter from being triggered into operation after the load means has ceased to constitute an effective load for said L-C circuit.

17. The power supply system of claim 15 wherein said L-C circuit comprises an inductor and a capacitor, and wherein said load means is effectively connected in parallel with said capacitor.

18. The power supply system of claim 17 wherein said load means comprises a voltage-limiting means.

* * * * *